US012557857B2

(12) United States Patent
Akins

(10) Patent No.: US 12,557,857 B2
(45) Date of Patent: Feb. 24, 2026

(54) COOLING BRA

(71) Applicant: Evolving Hearts Company, LLC, Peachtree Corners, GA (US)

(72) Inventor: Rochelle Akins, Peachtree Corners, GA (US)

(73) Assignee: Evolving Hearts Company, LLC

( * ) Notice: Subject to any disclaimer, the term of this patent is extended or adjusted under 35 U.S.C. 154(b) by 349 days.

(21) Appl. No.: 18/188,107

(22) Filed: Mar. 22, 2023

(65) Prior Publication Data

US 2023/0320434 A1 Oct. 12, 2023

Related U.S. Application Data

(60) Provisional application No. 63/322,980, filed on Mar. 23, 2022.

(51) Int. Cl.
*A41C 3/00* (2006.01)
*A41C 3/12* (2006.01)

(52) U.S. Cl.
CPC ..... *A41C 3/0085* (2013.01); *A41C 3/0057* (2013.01); *A41C 3/12* (2013.01)

(58) Field of Classification Search
CPC ..... A41C 3/0057; A41C 3/0085; A41C 3/12
See application file for complete search history.

(56) References Cited

U.S. PATENT DOCUMENTS 4,984,435 A * 1/1991 Seino ..... F25D 17/02 62/185
5,441,436 A * 8/1995 Moretz ..... A61F 5/44 450/38
2014/0276258 A1* 9/2014 Hall ..... A61N 1/0456 601/18
2015/0040286 A1* 2/2015 Schultz ..... A41D 1/00 2/88

(Continued)

FOREIGN PATENT DOCUMENTS

CN 111616428 A 9/2020
CN 212937940 U 4/2021

(Continued)

OTHER PUBLICATIONS

International Search Report and Written Opinion received for PCT Application No. PCT/US2023/016066, mailed on Jul. 17, 2023, 9 pages.

*Primary Examiner* — Gloria M Hale
(74) *Attorney, Agent, or Firm* — AEON Law, PLLC; Adam L.K. Philipp; Ki Yong O

(57) ABSTRACT

Disclosed herein is cooling sports bra that provides both support and cooling effect to a wearer. The cooling sports bra comprises a front panel configured to cover a chest area of a human torso. The front panel includes a first layer forming an outer surface, a second layer forming an inner surface, and a pair of front cooling pads are placed between the first and second layer. The front cooling pads are either fixed to the second layer or removable between the first and the (Continued)

second layer. The cooling sports bra further comprises a back panel coupled to the front panel, and the back panel includes at least one back cooling layer of a size and shape either fixed or removably attached to an inner surface of the back panel. The cooling sports bra further comprises a base support band coupled to the front and back panel.

19 Claims, 6 Drawing Sheets

(56) References Cited

U.S. PATENT DOCUMENTS

| | | | | |
|---|---|---|---|---|
| 2019/0008676 | A1* | 1/2019 | Kilbey | A41D 1/04 |
| 2022/0125615 | A1* | 4/2022 | Maher | A61B 5/4836 |
| 2023/0248085 | A1* | 8/2023 | Kilbey | A41D 13/0051 2/458 |

FOREIGN PATENT DOCUMENTS

| | | | |
|---|---|---|---|
| JP | 2020041244 | A | 3/2020 |
| KR | 101655784 | B1 | 9/2016 |

* cited by examiner

COOLING BRA

CROSS-REFERENCE TO RELATED APPLICATION

This application claims priority to U.S. provisional patent application No. 63/322,980, filed Mar. 23, 2022, titled "Cooling Sports Bra," and naming Rochelle Akins as the inventor. The entire contents of the above-referenced applications and of all priority documents referenced in the Application Data Sheet filed herewith are hereby incorporated by reference for all purposes.

FIELD

The present disclosure relates to a sports garment, in particular, a cooling sports bra.

BACKGROUND

Sports bras are a kind of sports garments that are designed to provide cover and support for a wearer's breasts while the wearer is engaging in physical activities or daily tasks. However, some individuals may find these bras uncomfortable, especially after sweating, because they are typically made with thick and non-breathable materials that restrict the movement of breast tissue. This can lead to skin irritation caused by the sweat's contact with the non-breathable fabric. Moreover, sports bras are often inadequate in terms of heat dissipation due to the thick and non-breathable fabrics, and extra layers and paddings. Cooling sports bras are desirable for effectively dissipating body heat through cooling technology.

BRIEF SUMMARY OF THE INVENTION

Apparatuses described herein relate to cooling sports bras that provide a wearer with both sufficient support and cooling sensation during physical activities. Cooling sports bras can effectively dissipate body heat and decrease the wearer's body temperature.

According to some embodiments, a garment is disclosed. The garment includes a front panel configured to cover a chest area of a human torso and a back panel configured to cover a back area of the human torso.

According to some embodiments, the front panel includes a first layer forming an outer surface of the garment, a second layer forming an inner surface of the garment, and a pair of removable front cooling pads placed between the first and the second layer.

According to some embodiments, each of the removable front cooling pads is configured to cover a portion of a breast and each of the removable front cooling pads includes a front cooling layer.

According to some embodiments, the back panel includes at least one back cooling pad removably attached to an inner surface of the back panel and the at least one back cooling pad includes a back cooling layer.

According to some embodiments, the garment further includes a base support band coupled to the front panel and the back panel and the base support band is configured to encircle the human torso.

According to some embodiments, the garment further includes a shoulder strap extending from the front panel to the back panel.

According to some embodiments, each of the front cooling pads includes a foam layer and the front cooling layer is attached to the foam layer.

According to some embodiments, each of the front cooling pads extends from a side edge to a mid-seam within the front panel.

According to some embodiments, the at least one back cooling pad extends from a back top edge to a back bottom edge within the back panel.

According to some embodiments, the back panel may comprise two back cooling pads separated by a back cutout.

According to some embodiments, the front cooling layer and the back cooling layer comprise polyurethane elastomer.

According to some embodiments, the front cooling layer and the back cooling layer comprise a thermoplastic polyurethane layer.

According to some embodiments, the first layer comprises an elastic material.

According to some embodiments, a second garment is disclosed. The second garment includes a first layer forming an outer surface of the garment, a second layer forming an inner surface of the garment, a middle layer placed between the first layer and the second layer, and a base support band coupled to the first layer, the second layer, and the middle layer. The base support band configured to encircle a human torso.

According to some embodiments, the second layer and the middle layer comprise a mesh material.

The foregoing summary is illustrative only and is not intended to be in any way limiting. Features from any of the disclosed embodiments can be used in combination with one another, without limitation. In addition to the illustrative aspects, embodiments, and features described above, further aspects, embodiments, and features will become apparent by reference to the drawings and the following detailed description.

DETAILED DESCRIPTION

Figure 1:
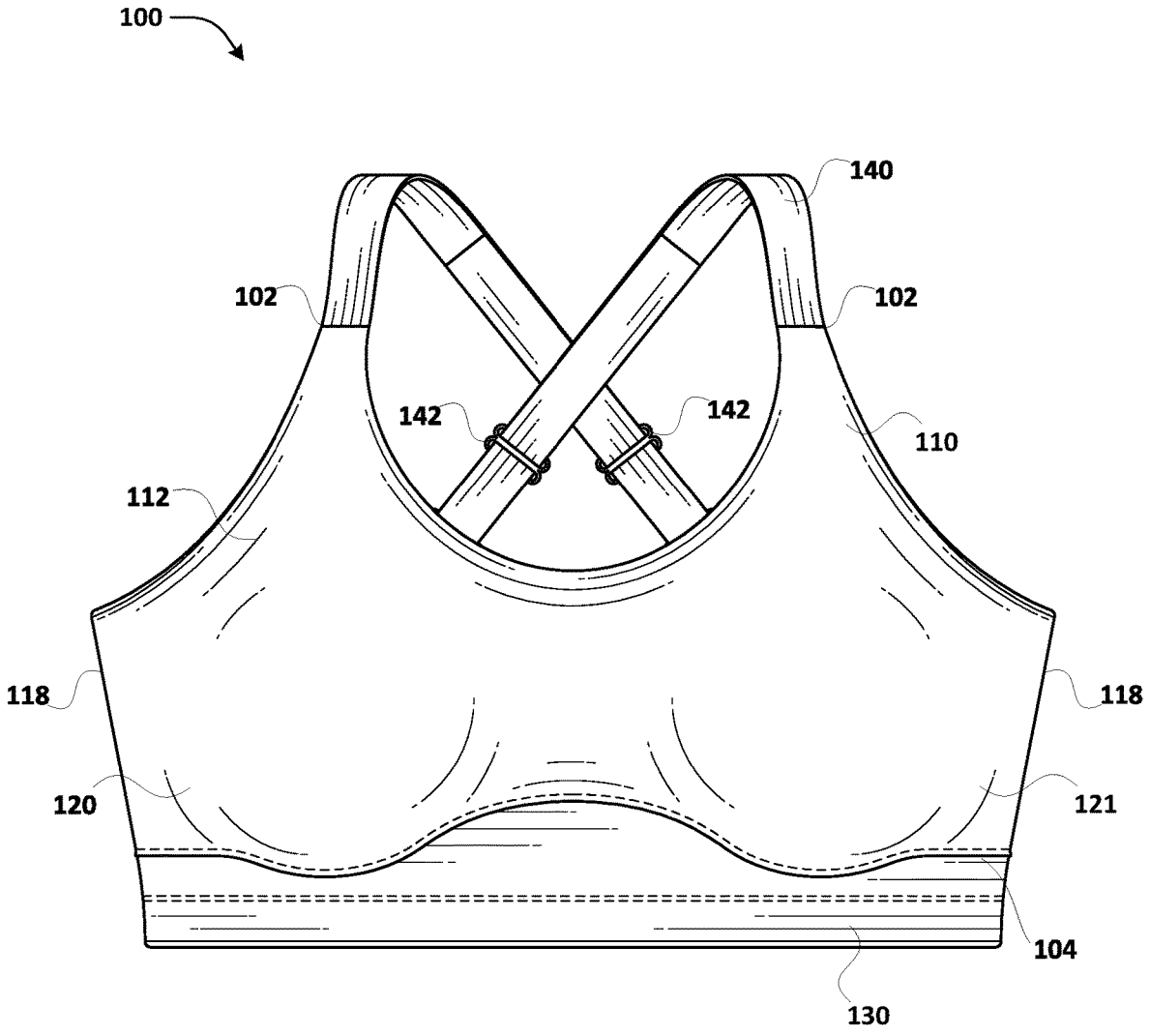
FIG. 1 is a schematic diagram illustrating a front view of an example cooling sports bra, according to some embodiments.

In overview, this disclosure relates to a cooling sports bra that provides both sufficient support and a cooling sensation to a wearer during physical activities.

In the following detailed description, reference is made to the accompanying drawings, which form a part hereof. In the drawings, similar symbols typically identify similar components unless context dictates otherwise. The illustrative embodiments described in the detailed description, drawings, and claims are not meant to be limiting. Other embodiments may be utilized, and other changes may be made, without departing from the spirit or scope of the subject matter presented here. In addition to other locations, defined terms may be found at the end of this Detailed Description.

Figure 2:
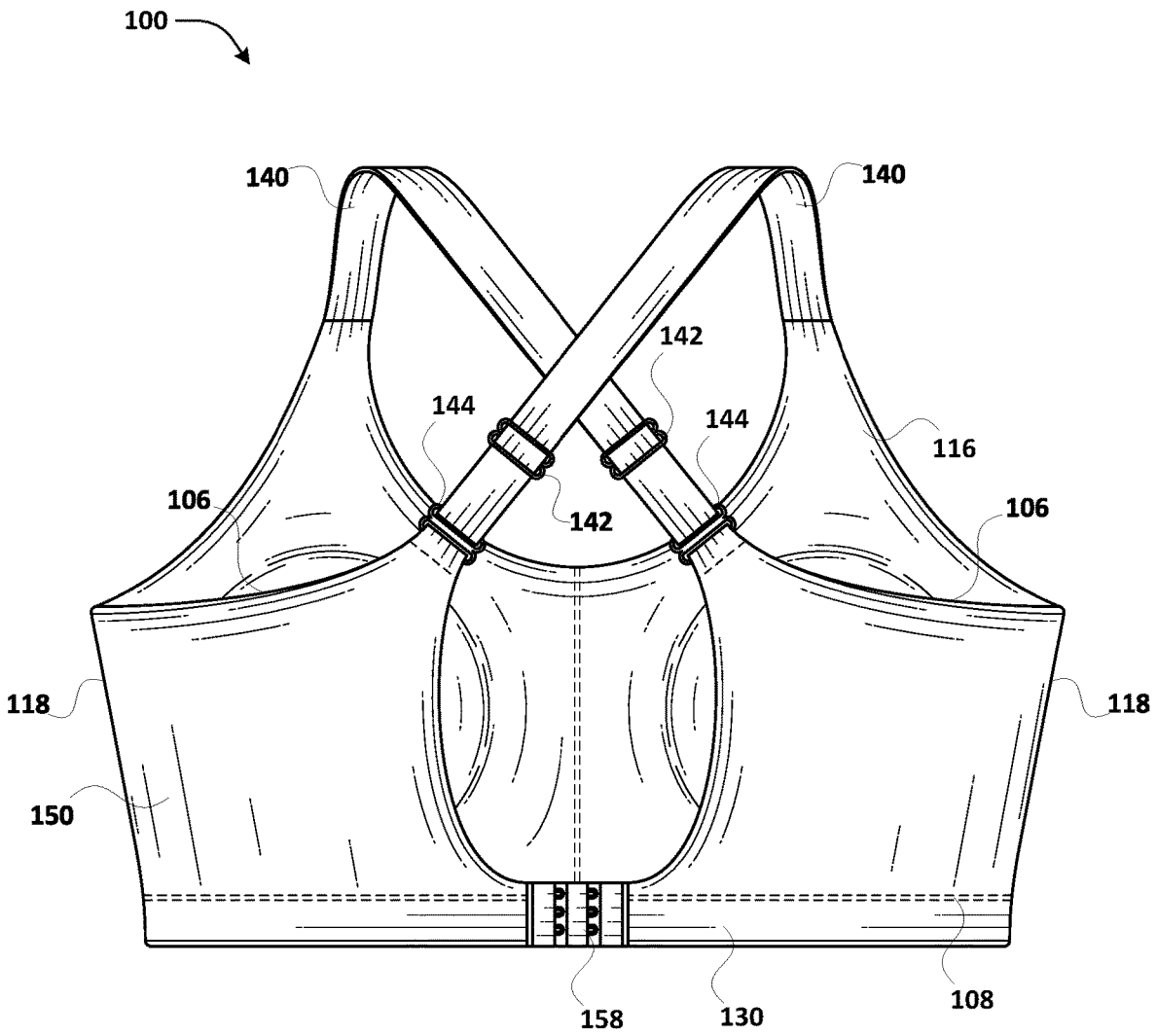
FIG. 2 is a schematic diagram illustrating a back view of the example cooling sports bra of FIG. 1, according to some embodiments.

While aspects discussed herein refer to bras, it should be noted that these aspects are not limited to any particular style or type of sports garment used to support breast tissues. Further, the drawings are for exemplary purposes only and are in no way meant to limit the scope of the present invention. For example, cooling sports bra 100 depicted in FIG. 2 is shown as having a back closure, but cooling sports bra 100 may have a front closure or may be a pull-over bra without any closure. Although the bras depicted in the drawings are shown as having shoulder straps, it should be noted that the bras may comprise removable shoulder straps or other designs such as a single strap or tie strings.

FIG. 1 is a schematic diagram illustrating a front view of an example cooling sports bra 100, according to some embodiments. The cooling sports bra includes a front panel 110 coupled to a base support band 130 and shoulder straps 140. The front panel 110 is configured to cover a chest area of a human torso. In the illustrated example in FIG. 1, the front panel 110 includes a pair of cups, right cup 120 and right cup 121, each of which is configured to cover and support a portion of a breast of a wearer. It should be understood that "front," "rear," "top," "bottom," "left," "right," and the like are only used to describe elements as they relate to one another but are in no way meant to recite specific orientations of the apparatus. For instance, the right cup 120 is on the wearer's right side when the cooling sports bra 100 is worn and is configured to cover and/or support the right breast of the wearer.

The front panel 110 includes a shell layer 112 forming an outer surface. The front panel 110 may include additional one or more liners underneath the shell layer 112. In an example embodiment, the front panel 110 includes two layers of liners, a middle layer 114 and an inner liner 116 (shown in FIGS. 2-6). The second liner 116 forms an inner surface facing the wearer's skin when the cooling sports bra 100 is worn. In another example embodiment, the front panel 110 may only have one liner, middle layer 114 or inner liner 116, in direct contact with the wearer's skin.

The front panel 110 is connected to the shoulder straps 140 at a front top edge 102 of the front panel 110. The base support band 130 is coupled to the front panel 110 at a front bottom edge 104. Although not shown in FIG. 1, the base support band 130 is coupled to a back panel 150 at back bottom edge 108 (shown in FIG. 2). The base support band 130 is located under the breasts and configured to encircle the human torso when the cooling sports bra 100 is worn. The front panel 110 is connected to the back panel 150 at side edges 118. Each of the side edges 118 is located under each of armholes.

FIG. 2 is a schematic diagram illustrating a back view of the example cooling sports bra 100 of FIG. 1, according to some embodiments. The back panel 150 includes a shell layer 152, forming an outer surface. The back panel 150 may include additional one or more liners underneath the shell layer 152. In an example embodiment, the back panel 150 includes two layers of liners, a middle layer 154 and an inner liner 156 (shown in FIGS. 2-6). The second liner 116 forms an inner surface facing the wearer's skin when the cooling sports bra 100 is worn. In another example embodiment, the back panel 150 may only have one liner, middle layer 154 or inner liner 156, in direct contact with the wearer's skin.

In the illustrated example, the shoulder straps 140 are configured to extend over the wearer's shoulders and connect to the front panel 110 and back panel 150, respectively. The shoulder straps 140 may include adjusters 142 configured to adjust the length of the shoulder straps. In an embodiment, the shoulder straps 140 are connected to the back panel 150 via connectors 144. The shoulder straps 140 may be fixed to the front panel 110 and removably attached to the back panel 150 as illustrated in FIGS. 1-2. As an alternative embodiment, the shoulder straps 140 may be removable via strap hooks, connectors, or fasteners to the front panel 110. The shoulder straps 140 may have different configurations such as standard, convertible, or racerback. Although the cooling sports bra 100 depicted in FIGS. 1-2 is shown with shoulder straps 140, it should be understood that in some other examples, the cooling sports bra 100 does not have any shoulder straps 140 or has a single strap. The shoulder straps 140 may have different configurations such as standard, convertible, or racerback.

In the illustrated embodiment, the cooling sports bra 100 includes a closure 158 enclosing the base support band 130. The back panel 150 includes a left wing and a right wing that can be connected and separated by closure 158. The closure 158 may be adjustable. In some other embodiment, closure 158 may be attached to the front panel 110. In some other embodiments, the cooling sports bra 100 may be a pull-over design that does not have any closure. As illustrated in FIG. 2, the cooling sports bra 100 has a back cutout above the closure 158 and between the left and right wing. In some other embodiments, the cooling sports bra 100 may be a racerback design that does not have the back cutout. In some front closure or pull-over designs, the back panel may be a one-piece covering the back area of the human torso.

The fabrication of cooling sports bra 100 is made for maximal comfort. The cooling sports bra 100 is structured with materials that help wick away moisture with its breathable material. The cooling sports bra 100 has great support due to the usage of tension fibers that can be stretched for comfort. The material of the cooling sports bra 100 may include polyester, nylon, and elastane as an outer shell. The threads are dyed to match the color of the shell material, along with dyed to match the adjustable strap hardware and soft bra-back extender.

The shell layer 112/152 may be made from breathable, elastic, stretchable, quick-dry, and moisture-wicking materials. For example, the shell layer 112/152 may comprise 80% of polyester and 20% spandex. The middle layer 114/154 and the inner liner 116/156 may be made from materials that are lightweight, breathable, soft, smooth, sheer, and stretchable. The middle layer 114/154 and the inner liner 116/156 may comprise the same or different material. For example, the middle layer 114/154 and inner liner 116/156 may comprise nylon/polyamide, polyester, or spandex. An example ratio of the material mixture is 85% of polyamide and 15% of spandex.

Figure 3:
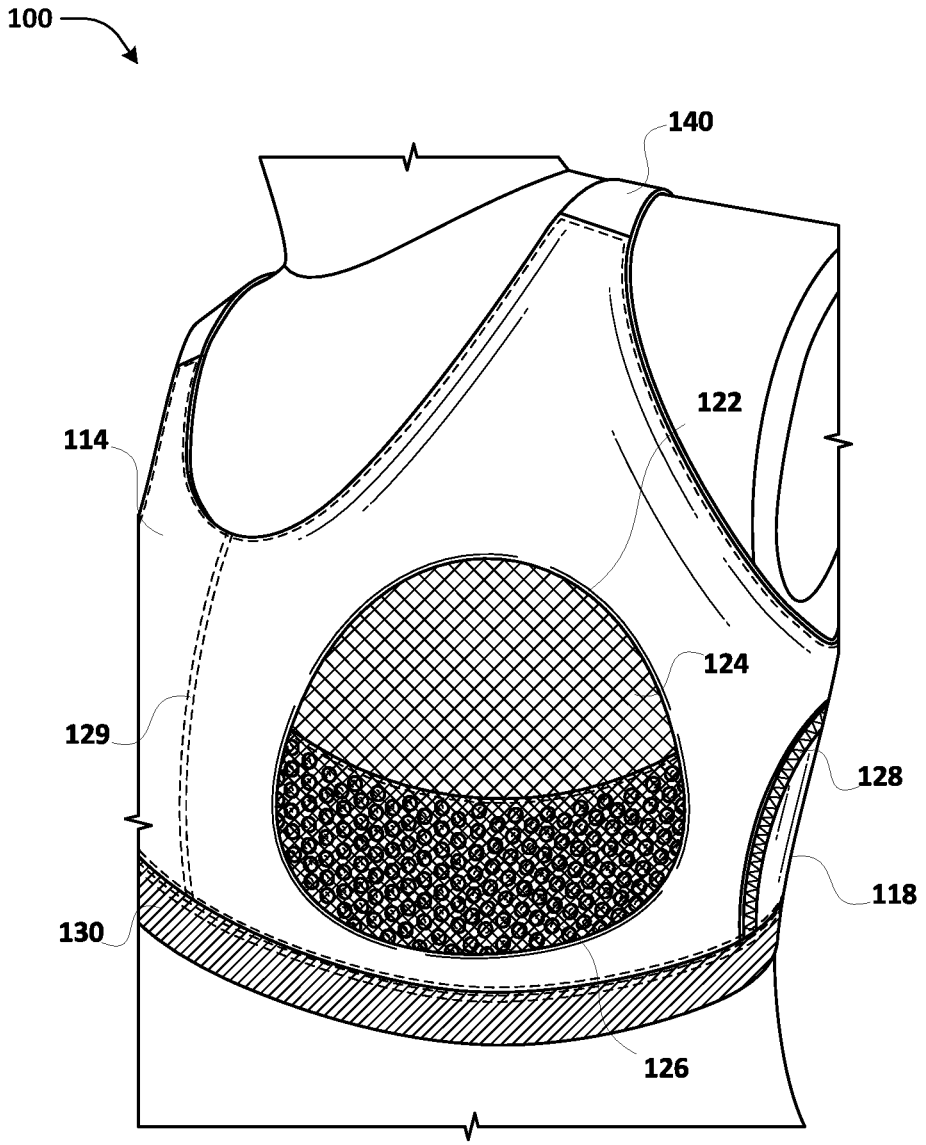
FIG. 3 is a schematic diagram illustrating a perspective view of cooling sports bra of FIG. 1, according to some embodiments.

FIG. 3 is a schematic diagram illustrating a perspective view of cooling sports bra 100 of FIG. 1, according to some embodiments. FIG. 3 shows an interior view of the front panel 110. In the illustrated embodiment, the inner liner 116 is not depicted in FIG. 3. A right front pad 122 is located at the right cup 120 of the cooling sports bra 100 covering the wearer's right chest. The right front pad 122 includes a foam layer 124 and a cooling layer 126. It should be understood that FIG. 3 shows the interior view of the cooling sports bra 100 and the right front pad 122 appears on the wearer's left side because the cooling sports bra 100 is inside out. The term "right" is a relative reference. The cooling layer 126 is attached to an inside surface of the foam layer and faces the wearer's skin. In an embodiment, the cooling layer 126 does not directly touches the skin and the inner liner 116 is placed between the skin and the cooling layer.

According to an embodiment, the right front pad 122 may be attached to the middle layer 114. The ways of attachment may be being sewn underneath or above the middle layer 114, or sewn to a cutout on the middle layer 114. In an alternative embodiment, the right front pad 122 may be removably placed between the middle layer 114 and the shell layer 112. The right front pad 122 may be accessible via an opening 128 located under an armhole and close to the side edge 118. In other example embodiments, the opening 128 may be located above the base support band 130 or near a mid-seam 129.

The sizes of the form layer 124 and the cooling layer 126 vary depending on the bra design and the wearer's breast size. The foam layer 124 should have a size sufficient to cover a substantial portion of a breast. FIG. 3 depicts an embodiment that the cooling layer 126 covers approximately half of the foam layer 124, usually referred to as a "half cup." The half-cup cooling layer 126 may have a height between 50-100 millimeters. Alternative configurations of the foam layer and the cooling layer are depicted in FIGS. 4-5.

Figure 4:
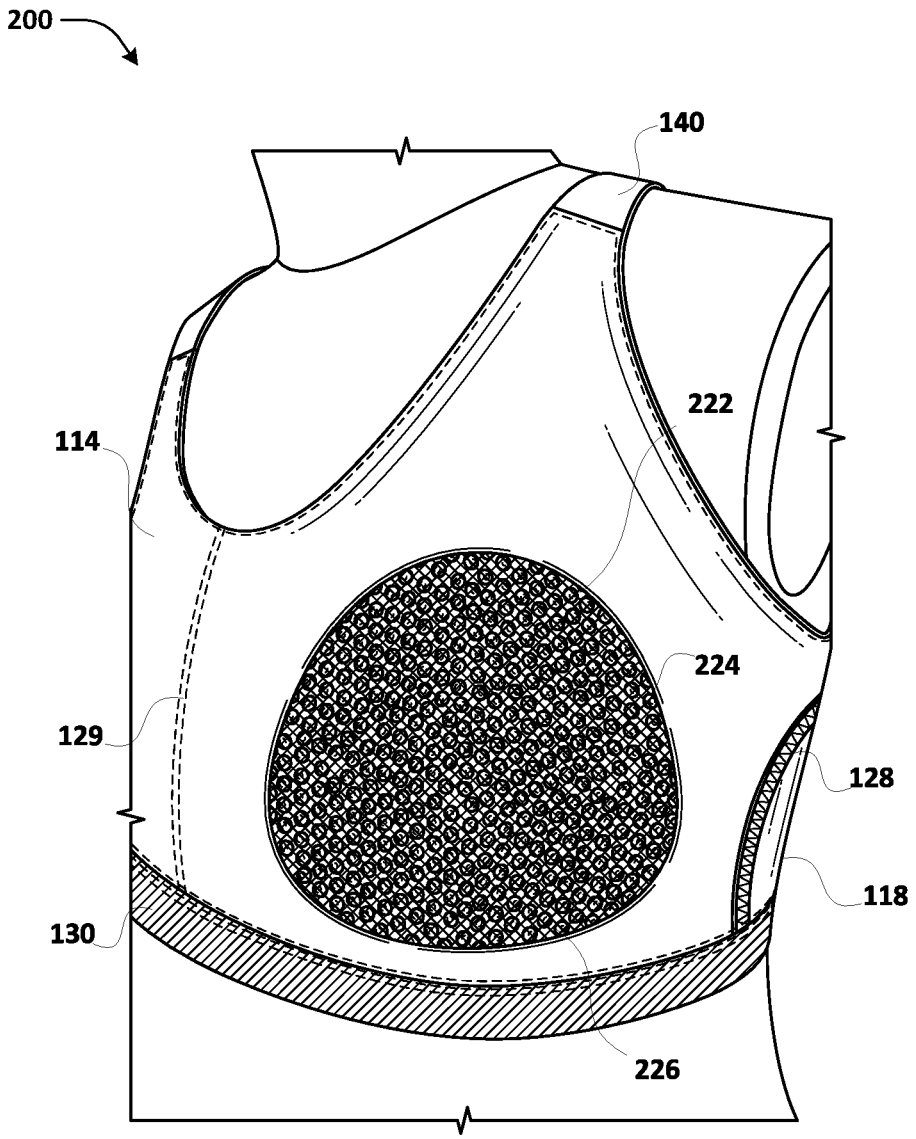
FIG. 4 is a schematic diagram illustrating a perspective view of another example cooling sports bra, according to some embodiments.

FIG. 4 is a schematic diagram illustrating a perspective view of cooling sports bra 200, according to some embodiments. FIG. 4 shows an alternative example of the interior view of the front panel 110. Compared to FIG. 3, FIG. 4 shows a "full cup" where the cooling layer 226 has a similar size as the corresponding foam layer 224. The full-cup cooling layer 226 may have a height between 120-180 millimeters. The foam layer 224 should have a size sufficient to cover a substantial portion of a breast.

Figure 5:
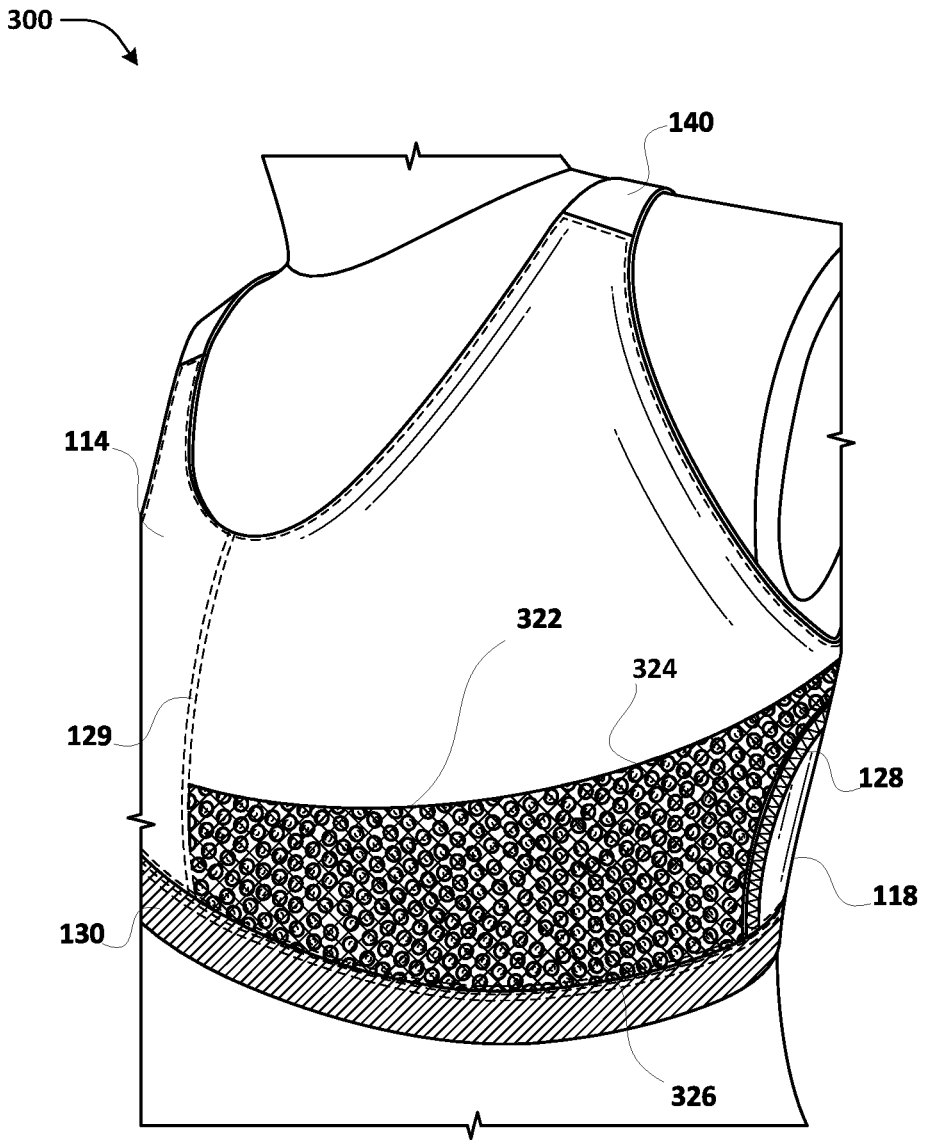
FIG. 5 is a schematic diagram illustrating a perspective view of another example cooling sports bra, according to some embodiments.

FIG. 5 is a schematic diagram illustrating a perspective view of cooling sports bra 300, according to some embodiments. FIG. 5 shows an alternative example of the interior view of the front panel 110. Instead of having a cup-shaped pad, cooling sports bra 300 has a front strip pad 322 extending between the mid-seam 129 to the side edge 118. The front strip pad 322 also has a foam layer 324 and a cooling layer 326. The front strip pad 322 may be removably attached or sewn to the middle layer 114.

Figure 6:
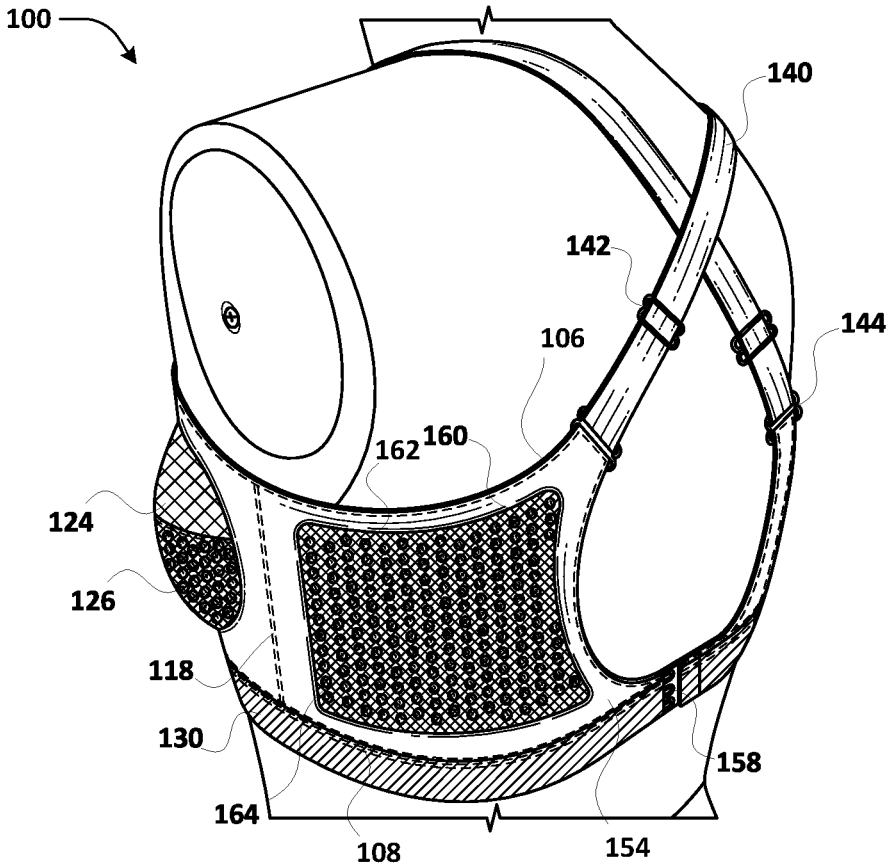
FIG. 6 is a schematic diagram illustrating a perspective view of cooling sports bra of FIG. 1, according to some embodiments.

FIG. 6 is a schematic diagram illustrating a perspective view of cooling sports bra 100, according to some embodiments. The back panel 150 includes a right back pad 160 having a foam layer 162 and a cooling layer 164 attached to the foam layer 162. The cooling layer 164 faces the wearer's skin. The right back pad 160 may be affixed to the middle layer 154. Alternatively, the right back pad 160 may be removably inserted between the middle layer 154 and the shell layer 152. The removable front and bad pads may be both accessible through the opening 128. There may be an additional opening on the back panel 150 between the back pads and the side edge 118 or between the back pads and the bottom edge 108.

In the example embodiment demonstrated in FIG. 6, the cooling sports bra 100 includes two separated back pads, right back pad 160 and left back pad 161 (not shown in FIG. 6) that are separated by the back cutout. In other embodiments where the cooling sports bra 100 does not have a back cutout, the back pad could be a one-piece placed extending between a back top edge 106 and back bottom edge 108.

Although FIGS. 4-5 only illustrate the configurations of various right front pads, it should be understood that the configurations of the left front pads correspond to the right front pads. Similarly, the left back pad 161 corresponding to the right back pad 160 is not shown in FIG. 6. It should be understood that the front pads and back pads may have different sizes and thicknesses to accommodate the appropriate level of support and comfort for the breasts.

Figure 7:
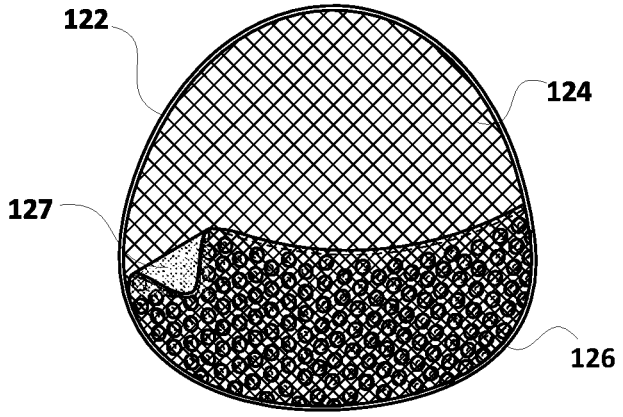
FIG. 7 is a schematic diagram illustrating a perspective view of a right front pad, according to some embodiments.

FIG. 7 is a schematic diagram illustrating a perspective view of right front pad 122, according to some embodiments. As illustrated in FIG. 7, the right front pad 122 includes the foam layer 124 and the cooling layer 126. It should be understood that each of the left and right front pads and the left and right back pads includes a foam layer and a cooling layer. The foam layer 124 may be molded memory foam or other like material. The foam layer 124 may be modulated based on breast size. For example, for larger sizes of breasts, the width and the thickness of the foam layer 124 may be increased to prover better coverage and support. In an example embodiment, the foam layer 124 has a thickness between 0.5-2 millimeters. The cooling layer has a thickness between 1-5 millimeters.

The cooling layer 126 may be made of polyurethane elastomers. Polyurethane elastomers are a type of elastic polymer that has high viscoelasticity and elasticity. The cooling layer 126 may be in the form of gel-like texture that is able to provide comfort and cooling sensation to the breasts. The gel-like texture may appear transparent or dyed in any chosen color, such as blue. The cooling layer 126 may comprise a plurality of gel dots arranged on an outer surface to create touch surface on the skin to help dissipate heat. The gel dots may have a diameter between 5-10 millimeters. have a smooth surface. An inner surface 127 of the cooling layer is attached to the foam layer 124. The inner surface 127 may include adhesive material so that the cooling layer 126 can be securely attached to the foam layer 124. Additional stitching may be required to attach the cooling layer.

In an example embodiment, the cooling layers may be covered by a thermoplastic polyurethane (TPU) film that protects the cup cooling layers from water so that the bra can be cleaned by water. In some other embodiments, the cooling layers may be covered by other water-resistant materials, such as silicone, polyurethane, and the like.

Besides polyurethane elastomers, the cooling layer 126 may also be made from other high heat absorbing materials, such as a thermally conductive material, a composite material having phase change characteristics. Some phase change material has a lower transition temperature between 18-22 degree Celsius, which is safe to the human body.

The surface of the cup and wings, when applied to the skin, brings the wearer a cooling sensation in the back and breast areas. The cooling layers will help relieve the sensation of body heat that is pinned up in those regions. The skin temperature covered by the cooling layer has been demonstrated to be 2-3 degrees Celsius lower than the adjacent skin. This will also help with improving moisture in the back and breast areas. The foam layer attached to the gel will help provide extra support and more comfortable wear. Women who are nursing, have sore breasts, chaffing, or struggling with securing the breast during extraneous activity will benefit from the design of the bra due to its texture and moldability to the form around the breast area due to the gel and foam being pliably soft while maintaining support.

As used herein, the term "bra" is meant to be construed broadly to cover any type of support garment configured to cover and provide support to a wearer's breasts. Thus, the term "bra" may include a traditional bra, a sports bra, a bandeau, a camisole, a swimsuit, and the like. The term "breast covering portion" used in relation to a bra means the portion of the bra that substantially or entirely covers the respective right and left breasts.

As used herein, the term "half cup" means a size that covers a breast in a range of from the button of the breast to below the nipple. A "full cup" means a size that covers a substantial portion of a breast that includes an area from the button of the breast to above the nipple.

The use of "including," "comprising," or "having" and variations thereof herein is meant to encompass the items listed thereafter and equivalents thereof as well as additional items. Unless specified or limited otherwise, the terms "affixed," "associated," "attached," "connected," "coupled" and "supported," and variations thereof are used broadly and encompass both direct and indirect connections, supports, and couplings. It is to be understood that other embodiments may be utilized, and structural or logical changes may be made without departing from the scope of the present disclosure. Furthermore, terms such as "front," "back," "top," "bottom," "left," "right," and the like are only used to describe elements as they relate to one another but are in no way meant to recite specific orientations of the apparatus, to indicate or imply necessary or required orientations of the apparatus, or to specify how the invention described herein will be used, mounted, displayed, or positioned in use.

The invention claimed is:

1. A garment, comprising: a front panel configured to cover a chest area of a human torso, including: a first layer forming an outer surface of the garment; a second layer forming an inner surface of the garment; a pair of removable front cooling pads placed between the first and the second layer, wherein each of the removable front cooling pads is configured to cover a portion of a breast and wherein each of the removable front cooling pads includes a front cooling layer facing the chest area, each of the front cooling pads includes a foam layer and wherein the front cooling layer is attached to the foam layer; a back panel configured to cover a back area of the human torso, wherein the back panel includes at least one back cooling pad removably attached to an inner surface of the back panel and wherein the at least one back cooling pad includes a back cooling layer facing the back area; and a base support band coupled to the front panel and the back panel, wherein the base support band is configured to encircle the human torso; and a shoulder strap extending from the front panel to the back panel.

2. The garment of claim 1, wherein each of the front cooling pads includes a foam layer and wherein the front cooling layer is attached to the foam layer.

3. The garment of claim 1, wherein each of the front cooling pads extends from a side edge to a mid-seam within the front panel.

4. The garment of claim 1, wherein the at least one back cooling pad extends from a back top edge to a back bottom edge within the back panel.

5. The garment of claim 1, wherein the back panel comprises two back cooling pads separated by a back cutout.

6. The garment of claim 1, wherein the front cooling layer and the back cooling layer comprise polyurethane elastomer.

7. The garment of claim 1, wherein the front cooling pads and the at least one back cooling pad comprise a thermoplastic polyurethane layer.

8. The garment of claim 1, wherein the first layer comprises an elastic material.

9. The garment of claim 1, wherein the second layer comprises a mesh material.

10. A garment, comprising: a first layer forming an outer surface of the garment; a second layer forming an inner surface of the garment; a middle layer placed between the first layer and the second layer; and a base support band coupled to the first layer, the second layer, and the middle layer, the base support band configured to encircle a human torso; wherein the first layer, the second layer, and the middle layer are coupled to form a front panel and a back panel, the front panel configured to cover a chest area of the human torso and the back panel configured to cover a back area of the human torso; wherein the front panel comprises a pair of front cooling pads affixed to the middle layer, each of the front cooling pads configured to cover a portion of a breast and each of the front cooling pads including a front cooling layer facing the chest area, wherein the front cooling pads and the back cooling pads are configured to provide a cooling sensation by incorporating a thermoplastic polyurethane layer; and wherein the back panel comprises at least one back cooling pad affixed to the middle layer and wherein the at least one back cooling pad includes a back cooling layer facing the back area.

11. The garment of claim 10, wherein each of the front cooling pads includes a foam layer and wherein the front cooling layer is attached to the foam layer.

12. The garment of claim 10, wherein the at least one back cooling pads includes a foam layer and wherein the back cooling layer is attached to the foam layer.

13. The garment of claim 10, wherein each of the front cooling pads extends from a side edge to a mid-seam within the front panel.

14. The garment of claim 10, wherein the at least one back cooling pad extends from a back top edge to a back bottom edge within the back panel.

15. The garment of claim 10, wherein the back panel comprises two back cooling pads separated by a back cutout.

16. The garment of claim 10, wherein the front cooling layer and the back cooling layer comprise polyurethane elastomer.

17. The garment of claim 10, wherein the front cooling layer and the back cooling layer comprise a thermoplastic polyurethane layer.

18. The garment of claim 10, wherein the first layer comprises an elastic material.

19. The garment of claim 10, wherein the second layer and the middle layer comprise a mesh material.

* * * * *